US008159412B2

(12) United States Patent
Yun et al.

(10) Patent No.: US 8,159,412 B2
(45) Date of Patent: Apr. 17, 2012

(54) ISOLATION ANTENNA FOR REPEATER

(75) Inventors: Je-hoon Yun, Daejeon (KR); Soon-ik Jeon, Daejeon (KR); Jong-sik Lim, Daejeon (KR); Jung-ick Moon, Daejeon (KR); Joung-myoun Kim, Daejeon (KR); Seung-won Kim, Daejeon (KR); Yong-tae Lee, Daejeon (KR); Chang-joo Kim, Daejeon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 654 days.

(21) Appl. No.: 11/722,317

(22) PCT Filed: Dec. 21, 2005

(86) PCT No.: PCT/KR2005/004429

§ 371 (c)(1), (2), (4) Date: Sep. 15, 2008

(87) PCT Pub. No.: WO2006/068419

PCT Pub. Date: Jun. 29, 2006

(65) Prior Publication Data

US 2009/0213021 A1 Aug. 27, 2009

(30) Foreign Application Priority Data

Dec. 21, 2004 (KR) ..... 10-2004-0109406

(51) Int. Cl.
*H01Q 1/12* (2006.01)

(52) U.S. Cl. ..... 343/890; 343/726

(58) Field of Classification Search ..... 343/726, 343/879, 878, 893, 841, 842, 885, 890, 846, 343/843, 836

See application file for complete search history.

(56) References Cited

U.S. PATENT DOCUMENTS 4,319,249 A * 3/1982 Evans et al. ..... 343/703
5,038,151 A * 8/1991 Kaminski ..... 343/727
5,949,382 A 9/1999 Quan (Continued)

FOREIGN PATENT DOCUMENTS

EP 1071160 1/2001

(Continued)

OTHER PUBLICATIONS

Karode, S.L., et al. (1999). "Dual Polarised Microstrip Patch Antenna Using Feedforward Isolation Enhancement for Simultaneous Transmit/Receive Applications." *National Conference on Antennas and Propagation*. Mar. 30-Apr. 1, 1999. Conference publication No. 461, IEE 1999. pp. 49-52.

(Continued)

*Primary Examiner* — Jacob Y Choi
*Assistant Examiner* — Kyana R McCain
(74) *Attorney, Agent, or Firm* — Ladas & Parry LLP

(57) ABSTRACT

Provided is an isolation antenna for a repeater which can acquire high isolation by using loop and dipole antennas, which are positioned in opposite directions to each other based on a shielding means, in a unidirectional repeater generally used in broadcasting or wireless communications even though transmitting antenna/receiving antennas having a co-channel are set up closely to each other. The transmitting/receiving isolation antenna includes: a shielding means including an electric conductor; a first antenna of a dipole antenna type in one side of the shielding means; and a second antenna of a loop antenna type in an opposite side of the shielding means where the first antenna is positioned.

20 Claims, 11 Drawing Sheets

U.S. PATENT DOCUMENTS

| | | | | |
|---|---|---|---|---|
| 6,531,984 | B1 | 3/2003 | Johannisson et al. | |
| 6,731,904 | B1 * | 5/2004 | Judd | 455/11.1 |
| 6,934,511 | B1 * | 8/2005 | Lovinggood et al. | 455/11.1 |
| 2002/0135523 | A1 | 9/2002 | Romero et al. | |

FOREIGN PATENT DOCUMENTS

| | | |
|---|---|---|
| KR | 102002004623 | 6/2002 |
| KR | 102003002197 | 3/2003 |
| KR | 102004002738 | 4/2004 |
| KR | 102004009134 | 10/2004 |

OTHER PUBLICATIONS

Hao, Y., et al. (2001). "Isolation and Enhancement of PBG Microstrip Diplexer Patch Antenna". *11th International Conference on Antennas and Propagation*. Apr. 17-20. Conference Publication No. 480. IEE 2001. pp. 86-89.

* cited by examiner

ISOLATION ANTENNA FOR REPEATER

TECHNICAL FIELD

The present invention relates to an isolation antenna for a repeater; and, more particularly, to a transmitting/receiving isolation antenna for separately using transmitting/receiving signals in a unidirectional repeater.

BACKGROUND ART

A wireless repeating technology separating transmitting/receiving signals in an antenna can be divided into a unidirectional repeating system and a bi-directional repeating system. A reception direction and a transmission direction are different from each other in the unidirectional repeating system, but they are the same in bi-directional repeating system.

Herein, a conventional unidirectional repeating system is a technology which can acquire high isolation by setting up antennas of high directivity in opposite directions with space between them. The technology is generally applied to a large repeater system such as a TV and a radio.

However, since the conventional technology requires isolation space between a transmitting antenna and a receiving antenna, it has a problem that a large space is required for setting up the antennas.

There is other conventional technology for generating transmission and reception signals whose polarization is vertical to each other by vertically setting up a feeder in a patch antenna and maintaining isolation between two terminals, although the technology is not practically applied to a system. The technology is revealed in an article by Karode, *IEE National Conference on Antennas and Propagation*, April 1999, pp. 49-52.

Also, Hao has realized an isolation technology by differently generating polarization of a patch antenna which applies a structure of Photo Band Gap (PBG) in an article, *IEE 11th International Conference on Antenna Propagation*, April 2001, pp. 86-89.

However, since isolation in a co-frequency for transmitting/receiving signals are very low as suggested in the above-result, there is a problem that the patch antenna is not proper to co-channel bi-directional communication in diverse mobile communication, local area network, broadcasting repeater and satellite communication fields which require high isolation in a co-frequency.

Also, the conventional technologies suggested by Karodo and Hao obtain isolation of less than 60 dB although transmitting/receiving frequency bands or polarizations are different from each other. Accordingly, it has a problem that isolation is not high sufficiently.

Therefore, the above-described conventional transmitting/receiving isolation technology cannot be used for an isolation antenna for a repeater requiring ultra isolation of more than 100 dB.

DISCLOSURE

Technical Problem

It is, therefore, an object of the present invention to provide an isolation antenna for a repeater which can acquire high isolation by using loop and dipole antennas, which are positioned in opposite directions to each other based on a cover, in a unidirectional repeater generally used in broadcasting or wireless communications even though transmitting antenna/receiving antennas having a co-channel are set up closely to each other.

Other objects and advantages of the invention will be understood by the following description and become more apparent from the embodiments in accordance with the present invention, which are set forth hereinafter. It will be also apparent that objects and advantages of the invention can be embodied easily by the means defined in claims and combinations thereof.

Technical Solution

In accordance with one aspect of the present invention, there is provided a transmitting/receiving isolation antenna for a repeater for maintaining isolation between transmission and reception signals in a unidirection, including: a shielding means including an electric conductor; a first antenna of a dipole antenna type in one side of the shielding means; and a second antenna of a loop antenna type in an opposite side of the shielding means where the first antenna is positioned.

Advantageous Effects

The present invention can acquire high isolation of more than 100 dB by using loop and dipole antennas, which are positioned in opposite directions to each other based on a shielding means even though transmitting antenna/receiving antennas having a co-channel are set up closely to each other.

Also, the present invention can be used as an antenna, which is proper to a unidirectional co-channel repeater such as a repeater for broadcasting and a wireless monitoring system.

Since the present invention can acquire high isolation of more than 100 dB even though transmitting antenna/receiving antennas are set up closely to each other, it can be implemented in a small space and manufactured as an integral type. Accordingly, it is possible to conceal the setup of the antenna not to spoil the appearance of a surrounding environment.

DESCRIPTION OF DRAWINGS

The above and other objects and features of the present invention will become apparent from the following description of the preferred embodiments given in conjunction with the accompanying drawings, in which.

BEST MODE FOR THE INVENTION

Other objects and advantages of the present invention will become apparent from the following description of the embodiments with reference to the accompanying drawings. Therefore, those skilled in the art that the present invention is included can embody the technological concept and scope of the invention easily. In addition, if it is considered that detailed description on prior art may blur the points of the present invention, the detailed description will not be provided herein. The preferred embodiments of the present invention will be described in detail hereinafter with reference to the attached drawings.

Figure 1:
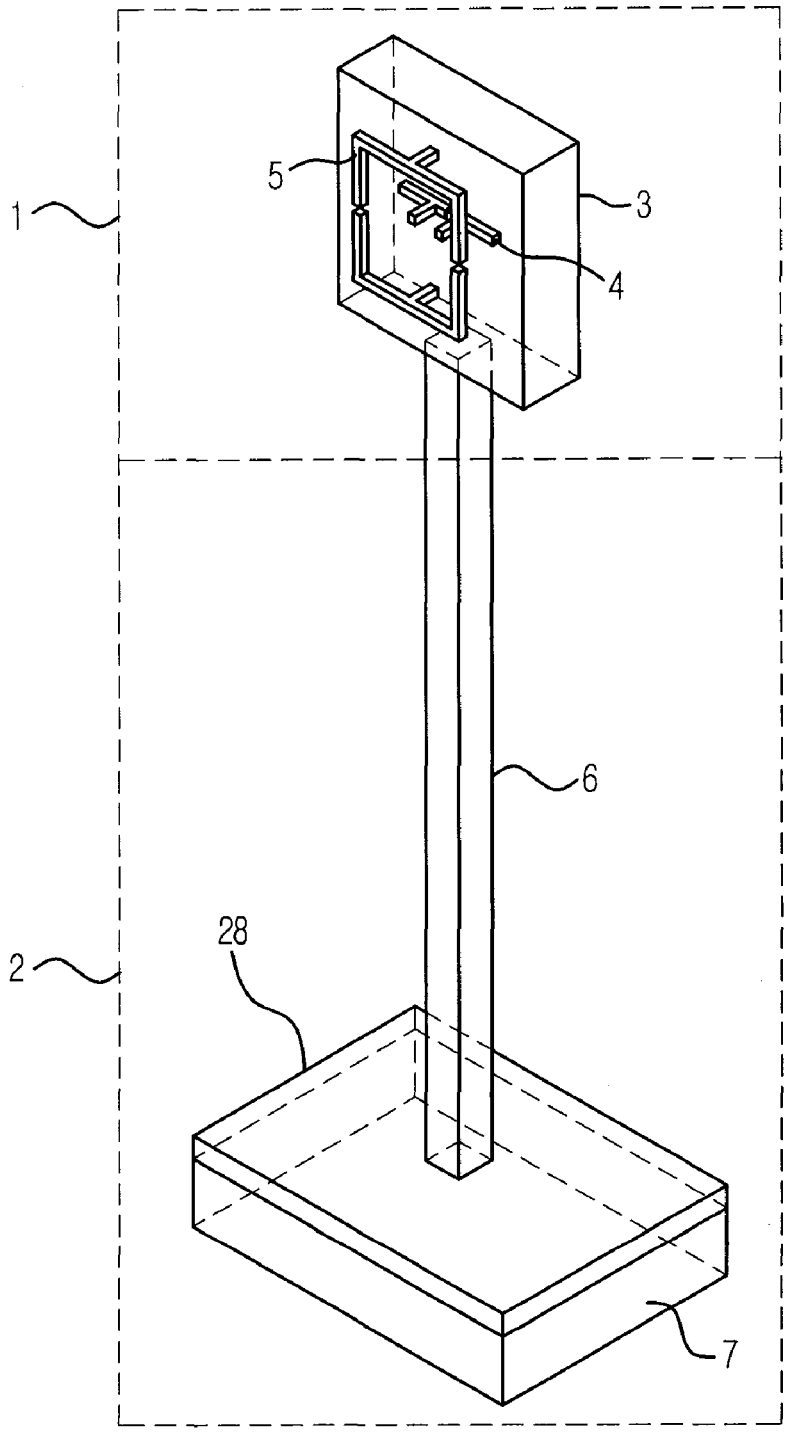
FIG. 1 is a perspective view showing an isolation antenna for a repeater in accordance with an embodiment of the present invention.

FIG. 1 is a perspective view showing an isolation antenna for a repeater in accordance with an embodiment of the present invention.

As shown in FIG. 1, the isolation antenna for the repeater of the present invention includes an antenna device 1 for generating and transmitting radiated electromagnetic wave, or receiving electromagnetic wave, and an antenna supporting unit 2 for supporting the antenna device 1.

Herein, the antenna device 1 includes a shield housing 3, which is covered with an electric conductor such as gold, silver, aluminum and copper and has a space inside, and a first antenna 4 and a second antenna 5, which are separately positioned in both sides based on the shield housing 3. Also, the antenna device 1 can further include a power combining unit 30 (not shown) in an inside of the shield housing 3.

Also, the antenna supporting unit 2 includes an antenna device supporter 6, which is set up in the center of the antenna device 1 to support the antenna device 1, and an antenna base 7 for holding up the antenna device supporter 6 to stand up on the ground.

Herein, radiated wave generated from the first antenna 4, which is a transmitting antenna, forms a second scattered wave in the antenna device supporter 6. As shown in the drawing, the antenna supporting unit 2 sets up one antenna device supporter 6 in the center of the antenna device or symmetrically sets up a plurality of antenna device supporters 6 such that the scattered wave can be symmetrically transmitted to the second antenna 5, which is a receiving antenna. It is very important to symmetrically maintain the scattered wave for the improvement of isolation.

Also, the antenna base 7, which is mainly set up on the ground, includes an electric wave absorbent 28 for absorbing electric wave in the upper part. It is preferred to symmetrically maintain the structure such that the scattered wave reflected by the ground can maintain symmetry.

In particular, when the size of the antenna device supporter 6 is small, it is required to maintain a symmetrical structure since the scattered wave generated by the earth largely affects on isolation.

The antenna base 7 can be formed in the shape of a rectangle, a cylinder as well as a square, and a section of the antenna device supporter 6 can be formed in a pipe shape of a cylinder as well as a square.

Figure 2:
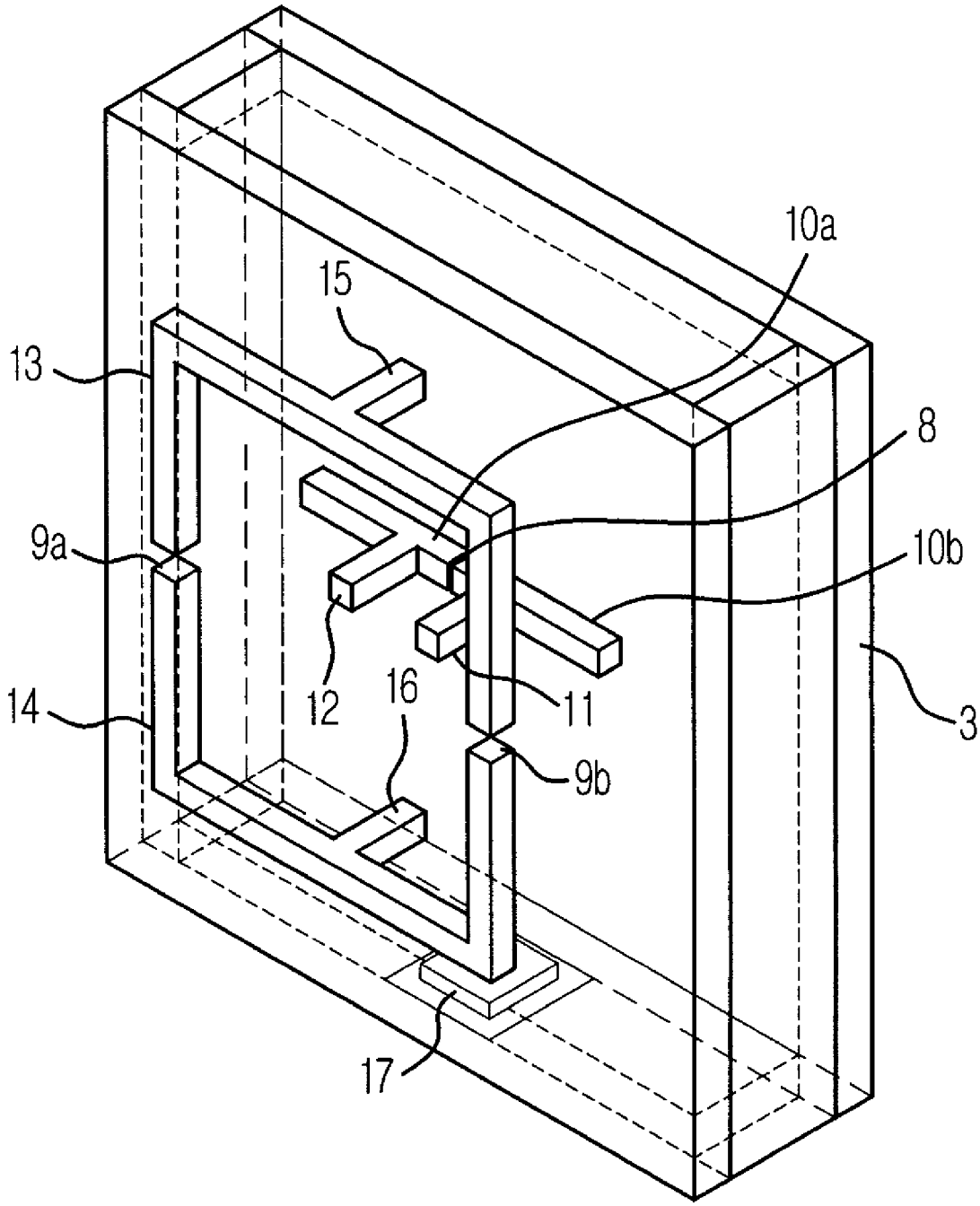
FIG. 2 is a perspective view showing the antenna device of the isolation antenna for the repeater in accordance with the embodiment of the present invention.

FIG. 2 is a perspective view showing the antenna device of the isolation antenna for the repeater in accordance with the embodiment of the present invention.

As shown in FIG. 2, a first antenna is a dipole antenna and it is formed of an electric conductor such as gold, silver, copper and aluminum. The first antenna includes the left and right antenna devices 10*a* and 10*b* for forming the dipole antenna, left and right antenna device supporters 12 and 11, and a first antenna feeding connector 8. The left and right antenna device supporters 12 and 11 are positioned in the centers of the left and right antenna devices 10*a* and 10*b* such that the left and right antenna device supporters 12 and 11 can be connected to the shield housing 3 with being isolated from the section of the shield housing 3 in parallel. The first antenna feeding connector 8 is positioned in the center of a position where the left and right antenna devices 10*a* and 10*b* meet each other.

Herein, the right and left antenna device supporters 11 and 12 are symmetrically set up based on a feeder and is formed of the electric conductor.

Meanwhile, a second antenna is formed of the electric conductor such as gold, silver, copper and aluminum, and has a form of a right angle loop antenna, that is, both sides of the second antenna are earthed with the shield housing.

The second antenna includes an upper antenna device 13 in the upper part of a right angle loop shape, a lower antenna device 14 in the lower part, upper and lower antenna device supporters 15 and 16 and left and right feeding connectors 9*a* and 9*b*. The upper and lower antenna device supporters 15 and 16 are positioned in centers of the upper and lower antenna devices 13 and 14, and fix the upper and lower antenna devices 13 and 14 in parallel at a predetermined distance from the shield housing 3.

Herein, the upper and lower antenna device supporters 15 and 16 are also formed of the electric conductor, and can set up supporters for the antenna device as a form of up and down symmetry in a position near from the centers, which are the left and right feeding connectors 9*a* and 9*b*, without changing a characteristic, just as the first antenna. In this case, the second antenna requires only 4 supporters, which can be more stable and firm in an external environment such as rain and wind by integrating the supporters with the second antenna.

Meanwhile, the reference number '17' in the lower part of FIG. 2 is an opening of the antenna device supporter for connecting the antenna device supporter of a pipe shape having a space inside to the inside of the shield housing.

Figure 3:
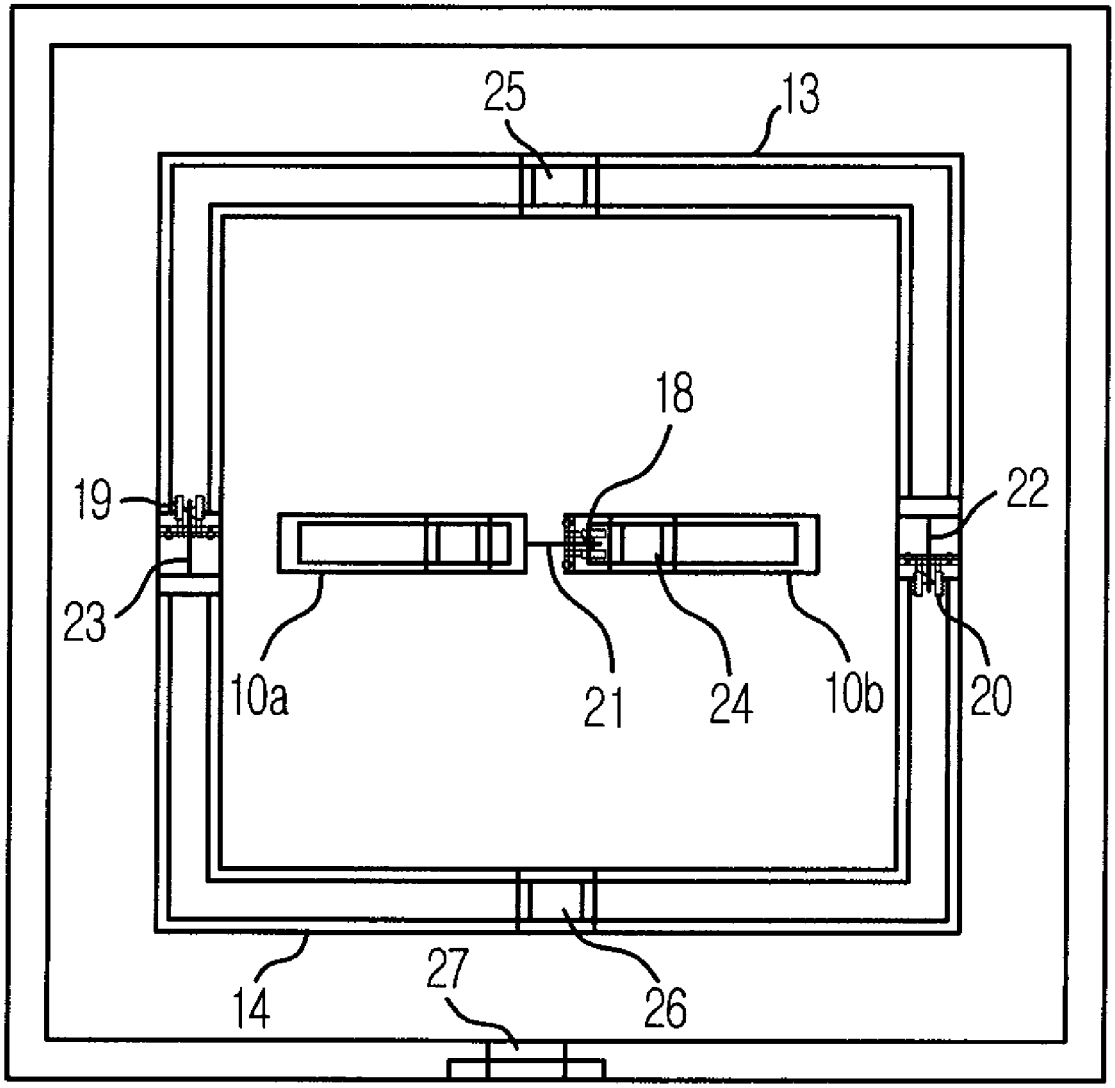
FIG. 3 is a front cross-sectional view showing the antenna device of the isolation antenna for the repeater in accordance with the embodiment of the present invention.

FIG. 3 is a front cross-sectional view showing the antenna device of the isolation antenna for the repeater in accordance with the embodiment of the present invention.

In the structure of the embodiment shown in FIG. 3, horizontal polarization can be generated by rotating the structure of FIG. 3 at 90°.

As shown in FIG. 3, the first antenna feeding connector includes a female screw 18 and a conductor pin 21.

Also, when the structure of the first antenna feeder is described in detail, the female screw 18 of the first antenna connector is positioned in the inside of the right antenna device 10*b* in the first antenna of a pipe shape having a space inside. The conductor pin 21 passes through the right antenna device 10*b* and is welded onto the left antenna device 10*a*.

Also, a coaxial cable having a connector is connected to the female screw 18 of the first antenna connector and the connected coaxial cable is positioned in the inside of the shield housing through an opening 24 of the right antenna device supporter of a pipe shape having a space inside.

Therefore, the isolation antenna for the repeater of the present invention can feed in parallel without a balun additionally since an outer cover of the coaxial cable for feeding is connected to the right antenna device 10*b* and an inner center of the coaxial cable is connected to the left antenna device 10*a*.

Meanwhile, the upper antenna device 13 of the second antenna is also formed in a pipe shape having a space inside. A left feeding connector is positioned in the left side of the upper antenna device 13 and it includes the female screw 19 and a conductor pin 23.

A female screw 19 of the left feeding connector is positioned in the inside of the upper antenna device 13 and the conductor pin 23 is welded onto the lower antenna device 14 through the lower antenna device 14.

Also, a coaxial cable, to which a connector having a male screw is connected, is connected to the female screw 19 of the left feeding connector, and the connected coaxial cable is positioned in the inside of the shield housing through an opening 25 of the upper antenna device supporter of a pipe shape having a space inside.

The second antenna lower antenna device 14 is formed in a pipe shape having a space inside. The right feeding connector is positioned in the right side of the lower antenna device 14 and it includes a female screw 20 and a conductor pin 22.

The female screw 20 of the right feeding connector is positioned in the inside of the lower antenna device 14 and the conductor pin 22 is welded onto the upper antenna device 13 through the lower antenna device 14.

A coaxial cable with a connector having the male screw in one end is connected to the female screw 20 set up in the inside of the lower antenna device 14. The connected coaxial cable is positioned in the inside of the shield housing 3 through an opening 26 of the lower antenna device supporter of a pipe shape having a space inside.

The left and right feeding connectors connected to the upper and lower antenna devices 13 and 14 of the second antenna can acquire the same characteristic even though left and right sides of the left and right feeding connectors are crossly set up. Therefore, it is possible to set up the connectors crossly.

Figure 4:
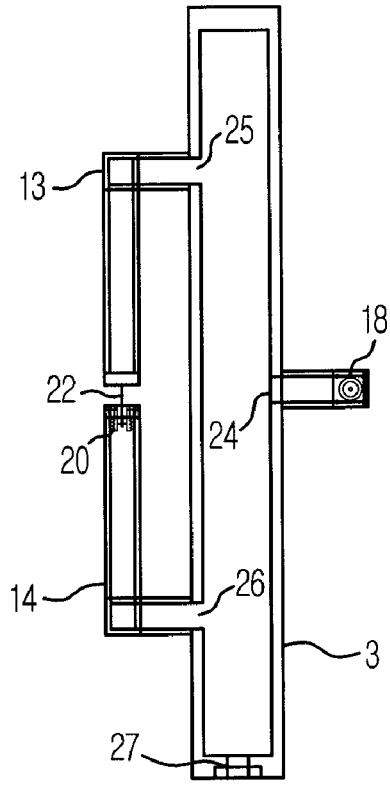
FIG. 4 is a side cross-sectional view showing the antenna device of the isolation antenna for the repeater in accordance with the embodiment of the present invention.

FIG. 4 is a side cross-sectional view showing the antenna device of the isolation antenna for the repeater in accordance with the embodiment of the present invention.

It is clearly shown in FIG. 4 that the opening 24 of the first antenna right device supporter, the opening 25 of the second antenna upper device supporter and the opening 26 of the second antenna lower device supporter are connected to the inside of the shield housing 3. The coaxial cable can be easily connected to each feeding connector terminal through the openings.

Figure 5:
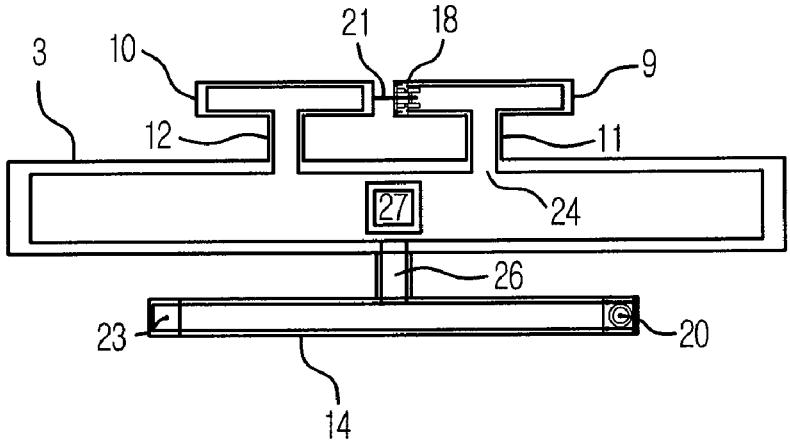
FIG. 5 is a plane cross-sectional view showing the antenna device of the isolation antenna for the repeater in accordance with the embodiment of the present invention.

FIG. 5 is a plane cross-sectional view showing the antenna device of the isolation antenna for the repeater in accordance with the embodiment of the present invention.

Since the left antenna device of the first antenna does not require to set up a feeding connector in the inside, it can be formed of a conductor which does not have a space inside.

Also, the shield housing includes an antenna device supporter opening 27 to be connected to the antenna device supporter 6.

The coaxial cable connected to the feeding connectors is set up in an antenna device supporter opening 27 such that the antenna device supporter opening 27 can be connected to a base station system through the inside of the antenna base 7 set up on the ground.

Figure 6:
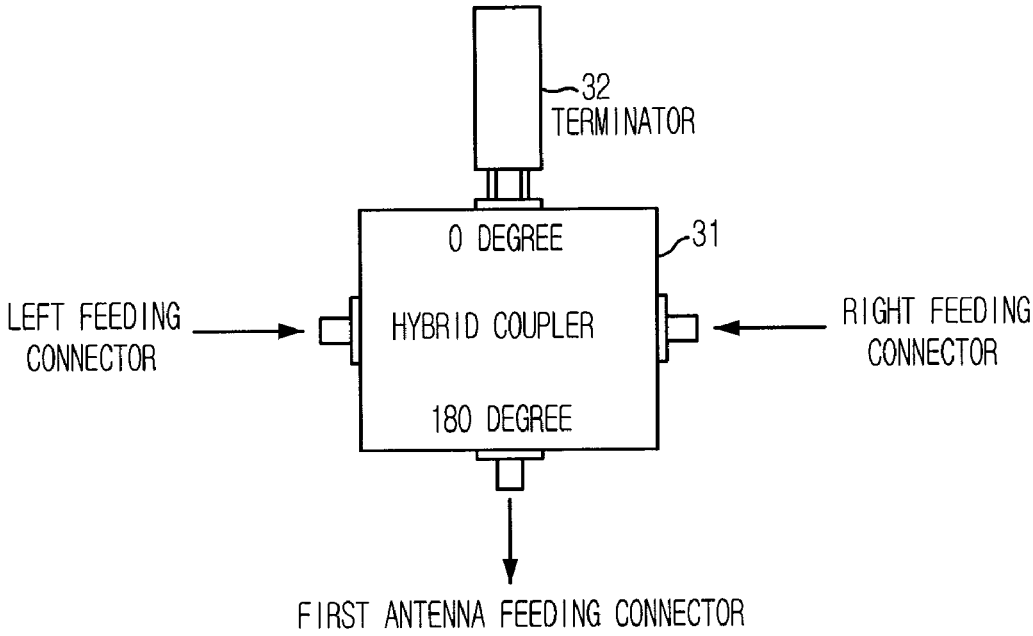
FIGS. 6 and 7 show power combining units in accordance with the first and second embodiments of the present invention, respectively.
Figure 7:
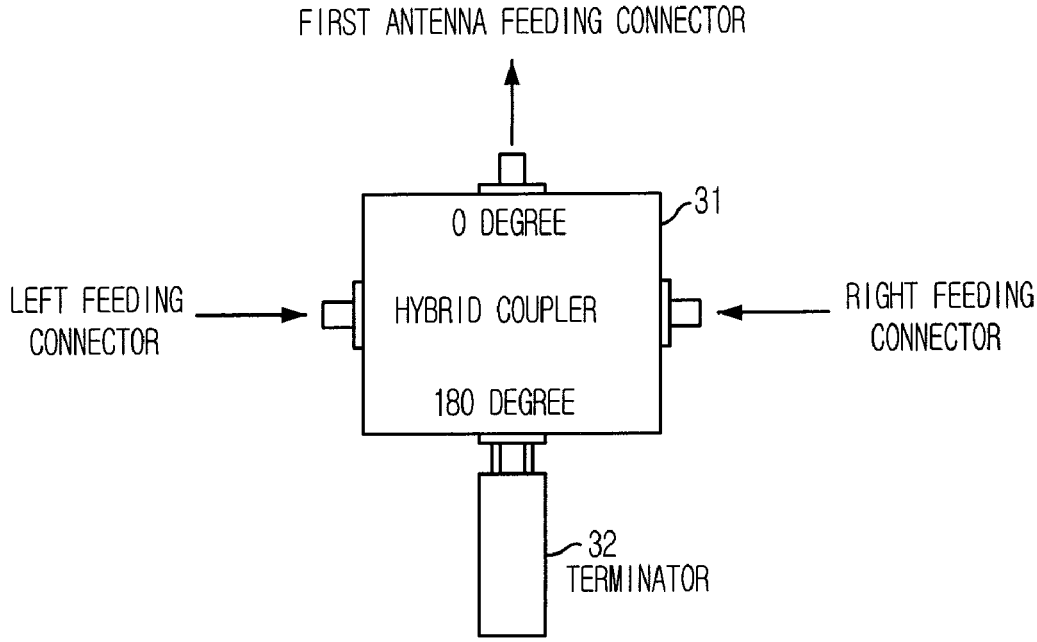

FIGS. 6 and 7 show power combining units in accordance with the first and second embodiments of the present invention, respectively.

As shown in FIGS. 6 and 7, the power combining unit of the present invention is positioned in the inside of the shield housing and includes 4-terminal hybrid combiner 31 and a terminator 32.

As shown in FIG. 6, the power combining unit of the present invention connects the left and right feeding connectors to the left and right terminals of the 4-terminal hybrid combiner 31 with coaxial cables having the same length, and connects the terminator 32 to a 0° terminal. Accordingly, the power combining unit can function as a power subtracting device.

As shown in FIG. 7, the power combining unit connects the left and right feeding connectors to the left and right terminals of the hybrid combiner 31 with coaxial cables having the same length, and connects the terminator 32 to a 180° terminal. Accordingly, the power combining unit can function as a power summating device.

Herein, a unidirectional repeater can be realized by connecting the other terminal of the hybrid combiner 31, i.e., an output terminal, to the first antenna feeding connector, and setting up the first antenna as a transmitting antenna.

In the isolation antenna for the repeater of the present invention, the electromagnetic wave defused from the ground maintains an opposite direction of the polarization direction of an electric field which goes through the left and right feeding connectors 9*a* and 9*b* of the second antenna.

Since electrodes in both sides of the first antenna are positioned in an opposite direction to each other, the electric field of the vertical polarization reflected from the ground by arrangement of an image maintains opposite directions in left and right.

When the left and right feeding connectors are fed through the power summating device of FIG. 7, which is realized as a device such as a 0° hybrid combiner, magic T and a power distributor, left and right feeding connector conductor pins of the second antenna are set up in up and down opposite to each other. Also, since the scattered wave obtained as the electromagnetic wave radiated from the first antenna is reflected from the ground maintains opposite phases in the left and right feeding connectors, the scattered wave is not removed and it becomes lower than isolation of each connector by 6 dB.

Therefore, when the left and right feeding connectors are connected by a device such as a 180° hybrid combiner and fed through the power subtracting device of FIG. 6, a signal can be removed by the reflected wave by the ground.

The power subtraction can be realized by setting up a 180° phase retarder in one terminal before connecting each terminal in the magic T or the power distributor.

The power combiner functioning as the power summating or the power subtracting device is set up in the inside of the shield housing 3 and can be connected to the coaxial cable, which is connected to the base station system, through opening 27 of the antenna device supporter. The power combiner also can connect two cables to the repeater system with the coaxial cable connected to the first antenna feeding connector.

When the isolation antenna for the repeater of the present invention is used as a low power repeater used in a wireless monitoring system, the isolation antenna can be realized to function as an independent repeater by setting up the entire repeater system such as an amplifier including a power suppler.

It is also possible to independently use the isolation antenna for the repeater of the present invention by separately supplying power to the antenna base 7. The latter makes it easy to set up/manage the antenna in a midrange repeater.

Figure 8:
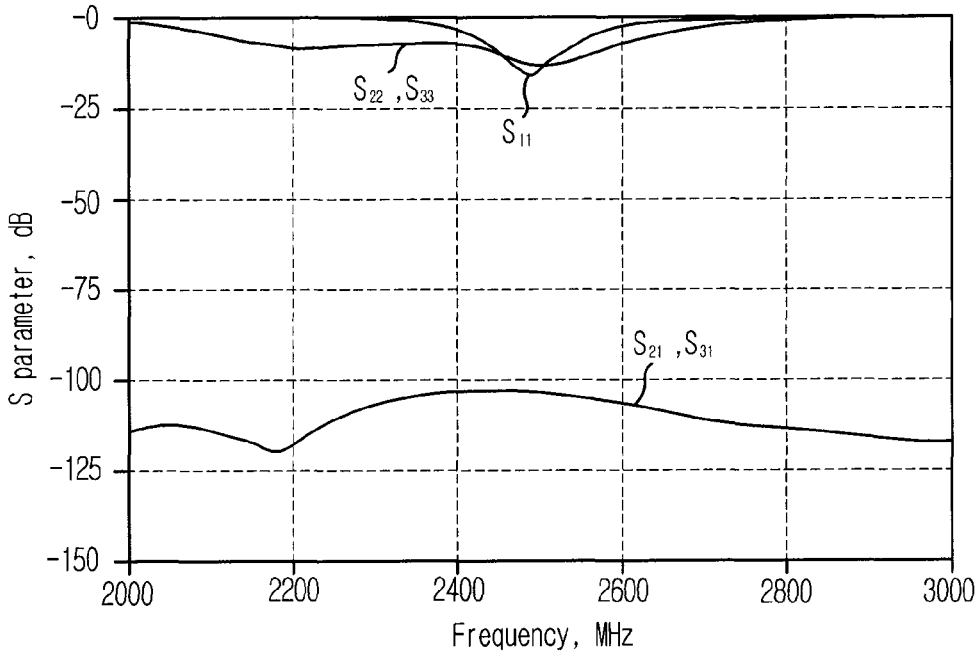
FIG. 8 is a graph showing an S parameter characteristic of the isolation antenna for the repeater of the present invention.

FIG. 8 is a graph showing an S parameter characteristic of the isolation antenna for the repeater of the present invention.

The specification of the isolation antenna for the repeater formed for the measurement is as follows.

The thickness of the first antenna was 0.2 cm×0.2 cm, and the entire length was 5.7 cm. The thickness of the second antenna was the same as the thickness of the first antenna and the size was 6 cm×6 cm. The shield housing was 2 cm×10 cm×10 cm.

As shown in FIG. 8, since both first and second antennas have resonance at 2.5 GHz and S11, S22 and S33 parameters maintain values of less than −10 dB, it is apparent that an impedance matching is excellent.

Also, when the first antenna feeding connector is used as a transmitting terminal, that is, when the first antenna is used as a transmitting antenna, isolation can be known through S21 and S31. Herein, the isolation, which is a rate that the electromagnetic wave radiated through the transmitting antenna is abandoned in the second antenna, is maintained at −108 dB.

Although it is not described in the specification of the present invention, an effect of the reflected wave by the ground can be reduced by increasing the size of the supporter since the strength of the reflected wave by the ground is in inverse proportion to the size of the antenna device supporter.

As described above, the reflected wave can be reduced more by setting up the electric wave absorbent 28 on the antenna base 7.

The isolation antenna for the repeater of the present invention can maintain a combination quantity of the second antenna by the first antenna at the level of less than −108 dB, which is a combination quantity excluding the reflected wave by the ground.

When the combination quantity is maintained, the electric field directly transmitted through the first antenna has the same intensity of amplification and the same phase in the left and right feeding points of the second antenna. Therefore, the signal directly transmitted from the second antenna can be removed by using the power summation of the left and right feeding connectors oppositely from the reflected wave by the ground.

Since it is possible to remove a signal more than 30 dB to 40 dB with a common product available in the market, isolation of more than a total of 140 dB can be acquired by realizing the power summation of the left and right feeding connectors.

Figure 9:
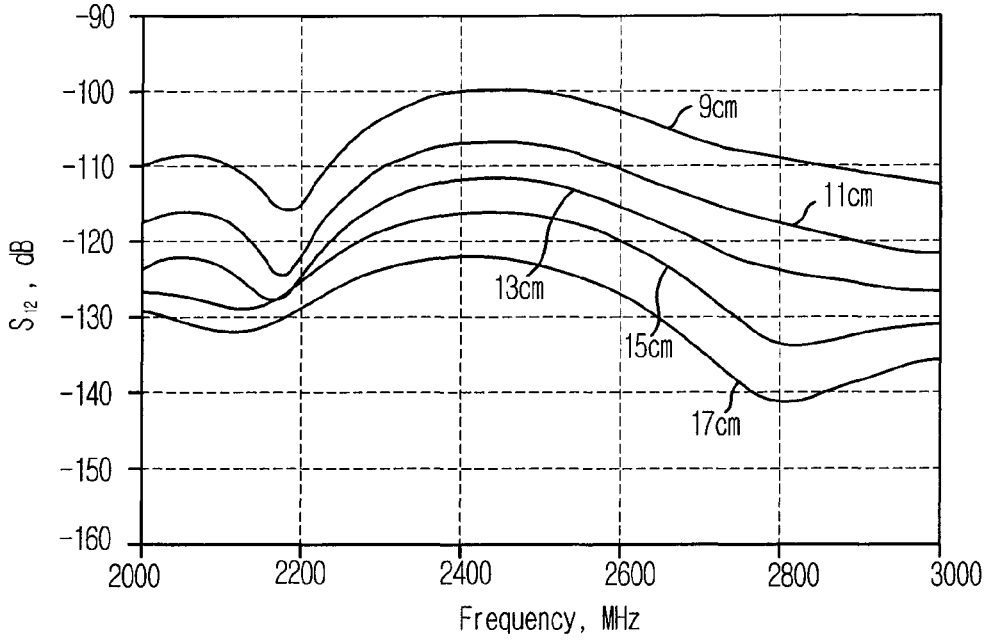
FIG. 9 is a graph showing an $S_{21}$ parameter characteristic based on the size of the shield housing in the isolation antenna for the repeater of the present invention.

FIG. 9 is a graph showing an $S_{21}$ parameter characteristic based on the size of the shield housing in the isolation antenna for the repeater of the present invention. FIG. 9 shows variation of isolation by the antenna device when the size of the shield housing is varied from 9 cm to 17 cm.

As shown in FIG. 9, when the size of the shield housing is varied from 9 cm to 17 cm, an improved rate of isolation is about 20 dB.

It is a result of measurement excluding the power combining unit. When the power summation of the left and right feeding connectors is realized by including the power combining unit, isolation of more than a total of 160 dB can be acquired under assumption that the measurement is performed in a place that the electromagnetic wave is not reflected by the ground.

When the combination quantity integrated through the reflected wave by the ground is more than −108 dB, the power summating device increases isolation as described above, and the power subtracting device removes the reflected wave signal by the ground. However, since the power subtracting device cannot remove the signal of the electromagnetic wave directly transmitted from the first antenna to the second antenna, isolation of maximum −102 dB can be maintained.

Figure 10:
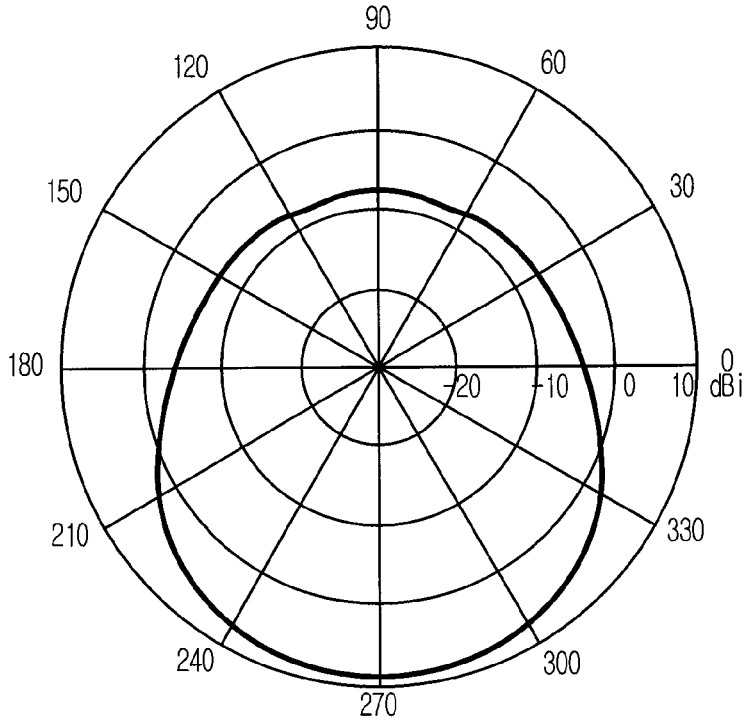
FIGS. 10 and 11 show electric field patterns of a horizontal polarization element by a first antenna in the isolation antenna for the repeater of the present invention, respectively.
Figure 11:
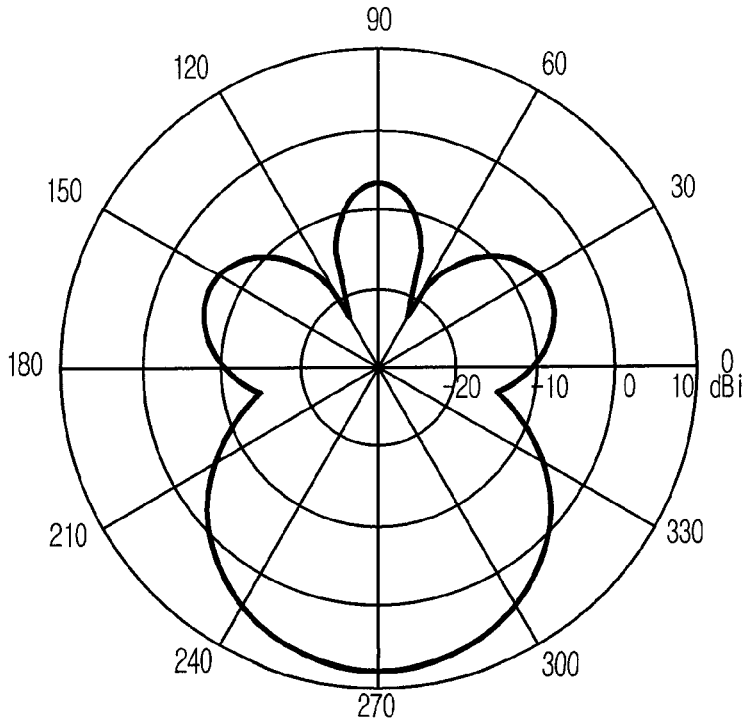

FIGS. 10 and 11 show electric field patterns of a horizontal polarization element by a first antenna in the isolation antenna for the repeater of the present invention, respectively. FIGS. 10 and 11 individually show the electric field patterns of an E plane, i.e., Φ=90° and an H plane, i.e., θ=90° in case that the first antenna is fed and the second antenna is terminated.

As shown in FIGS. 10 and 11, the isolation antenna for the repeater of the present invention has a gain of 8.9 dBi and it shows that the isolation antenna maintains directivity. Herein, a direction of the main beam is maintained at Φ=90 and θ=270°, and a beam band width of more than 0 dBi is maintained at about 90° in a direction of Φ.

Therefore, the isolation antenna for the repeater of the present invention is proper to a TV repeater antenna for broadcasting.

Figure 12:
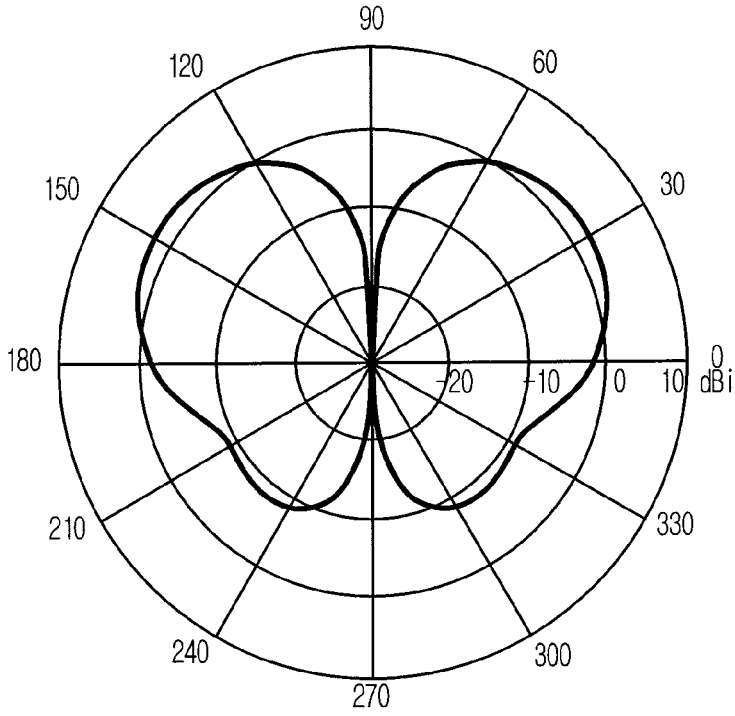
FIGS. 12 and 13 show horizontal polarization electric field patterns in case that the power combining unit of the isolation antenna for the repeater of the present invention is realized as a power summating device.
Figure 13:
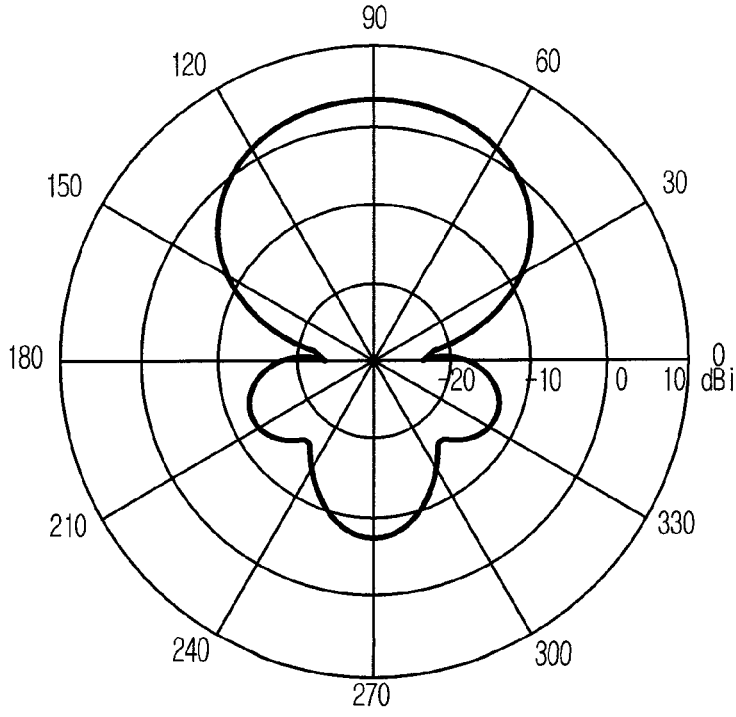

FIGS. 12 and 13 show horizontal polarization electric field patterns in case that the power combining unit of the isolation antenna for the repeater of the present invention is realized as a power summating device. FIGS. 12 and 13 individually show an electric field pattern of E plane, i.e., Φ=90° and H plane, i.e., θ=70°.

As shown in FIGS. 12 and 13, in the isolation antenna for the repeater of the present invention, when the power combining unit is connected to the first antenna feeding connector, a gain is 6.6 dBi and a main beam maintains a direction, in which θ is 50° or 130° and Φ is 90°.

Also, a main beam band of more than 0 dBi maintains a direction, in which θ is 0° to 75° and 105° to 180°, and a beam band maintains a width of about 60° in a direction of Φ. Herein, all polarizations maintain a horizontal polarization.

It is known from the result that the present invention is proper to a unidirectional repeater system.

Figure 14:
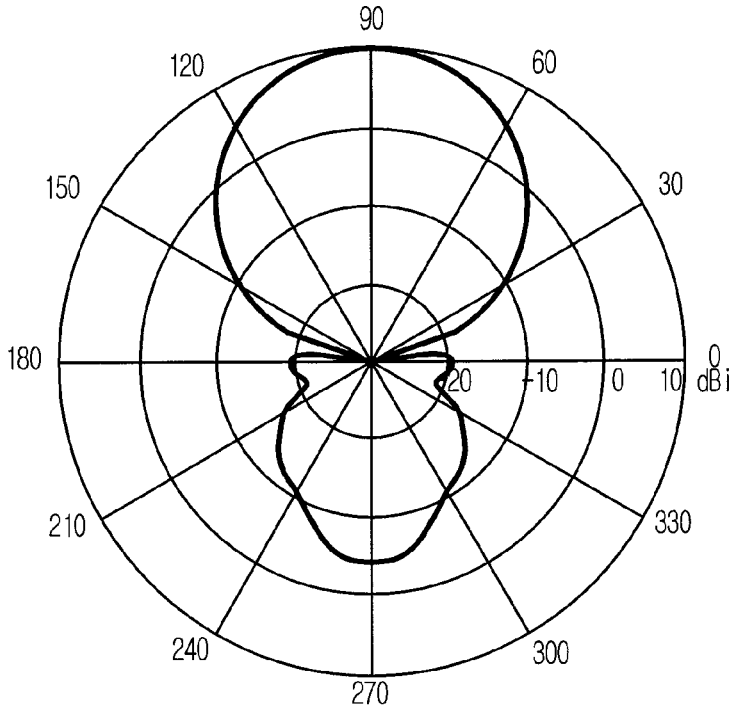
FIGS. 14 and 15 show vertical polarization electric field patterns in case that the power combining unit of the isolation antenna for the repeater of the present invention is realized as a power subtracting device.
Figure 15:
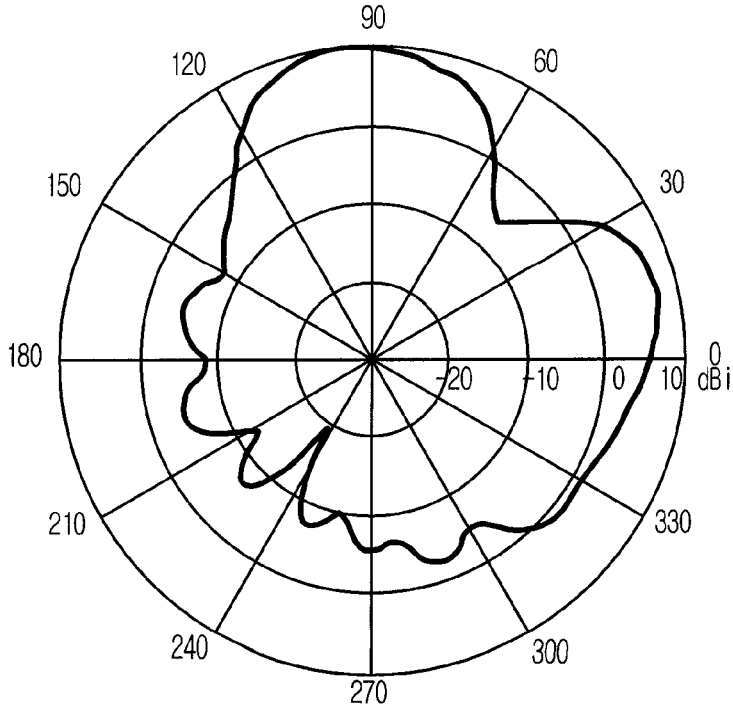

FIGS. 14 and 15 show vertical polarization electric field patterns in case that the power combining unit of the isolation antenna for the repeater of the present invention is realized as a power subtracting device. FIGS. 14 and 15 respectively show the electric field pattern of E plane, i.e., Φ=90° and H plane, i.e., θ=70°.

As shown in FIGS. 14 and 15, dual polarizations are generated between the first and second antennas, and it shows that the polarization can be used in a repeater or a communication system with different transmission/reception.

As described above, the isolation antenna for the repeater of the present invention has a structure capable of removing the reflected wave by the ground wave. Accordingly, the isolation antenna can be set up low and maintain a high gain of 9.8 dBi.

Figure 16:
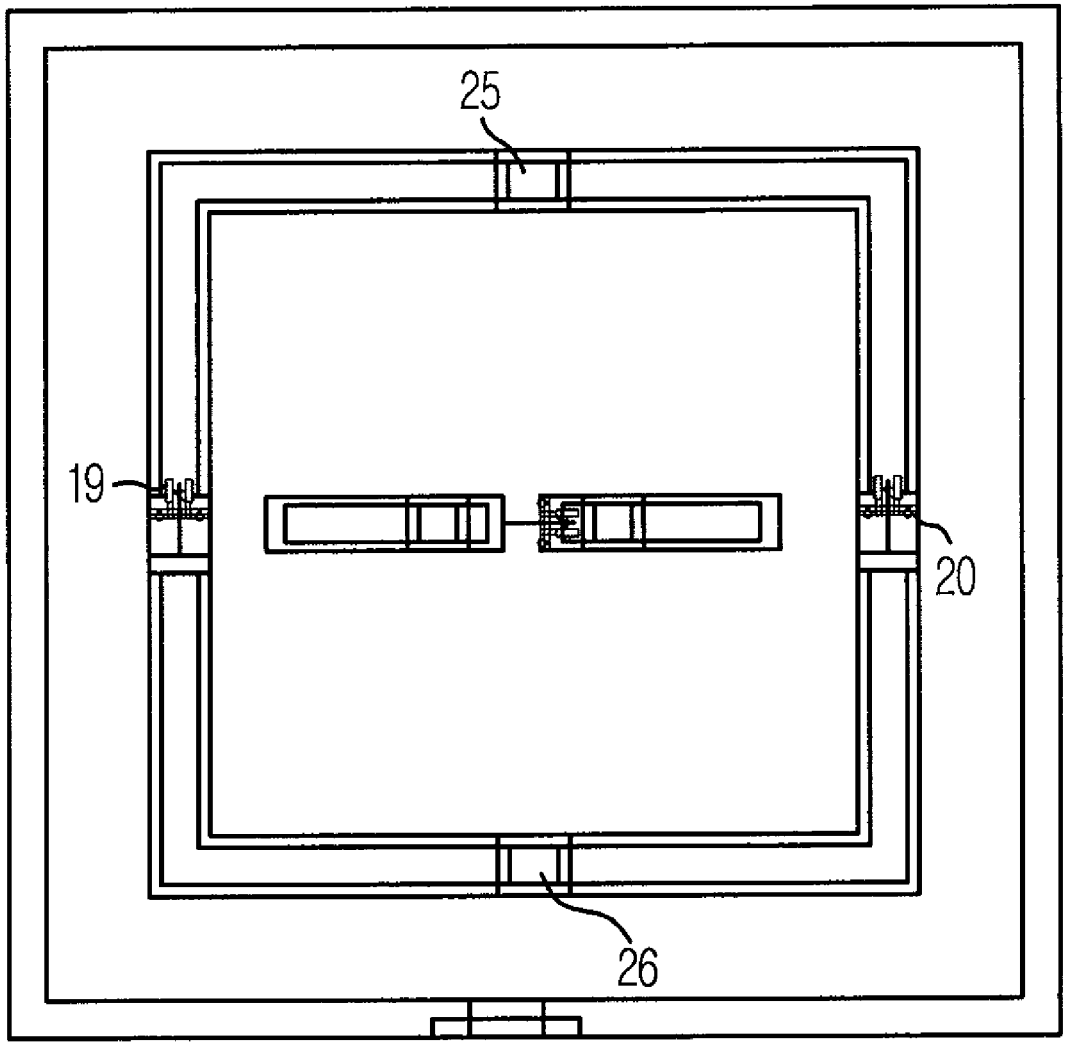
FIG. 16 is a diagram showing the isolation antenna for the repeater in accordance with the another embodiment of the present invention.

FIG. 16 is a diagram showing the isolation antenna for the repeater in accordance with another embodiment of the present invention.

As shown in FIG. 16, the isolation antenna for the repeater of the present invention can be realized by setting up the left and right feeding connectors 19 and 20 of the second antenna in the same direction.

When the isolation antenna is formed of the structure of the embodiment, the power subtraction and the power summation of the left and right feeding connectors can be realized in opposite to those of the embodiment described above with reference to FIGS. 2 to 5.

Since the power summating device has a simpler structure in comparison with the power subtracting device, it is more economical than the isolation antenna realized with the power summating device.

Figure 17:
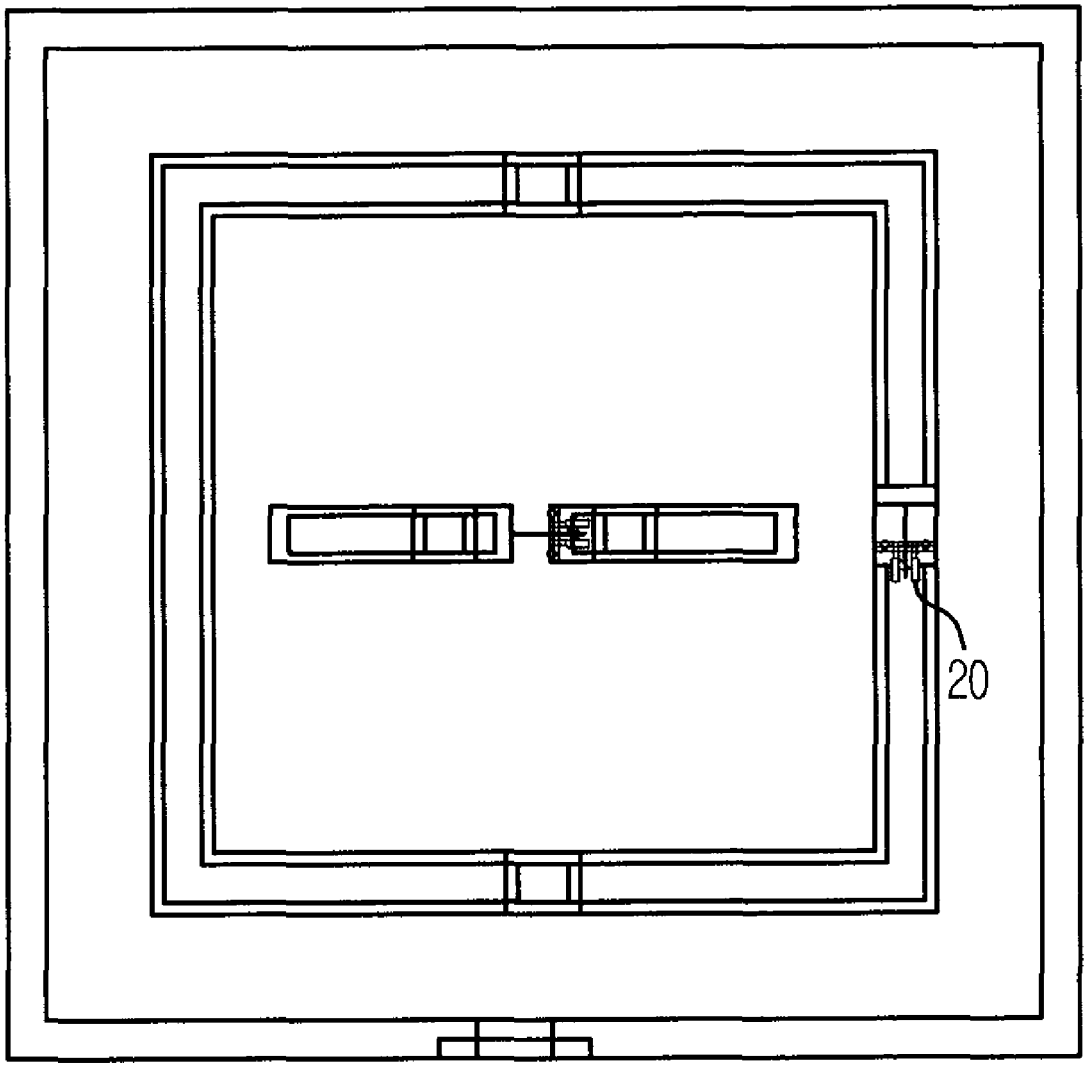
FIG. 17 is a diagram showing the isolation antenna for the repeater in accordance with yet another embodiment of the present invention.

FIG. 17 is a diagram showing the isolation antenna for the repeater in accordance with yet another embodiment of the present invention.

As shown in FIG. 17, in the isolation antenna for the repeater of the present invention, a feeder of the second antenna can be realized by using only one feeding connector.

It is a structure that the second antenna is formed by a single feeding method which does not require the power summating or the power subtracting devices.

In this case, it is possible to acquire a similar characteristics to the antennas of FIGS. 8 and 9 and economically realize the isolation antenna since the power combining unit is not required to realize the power summation and subtraction. However, the isolation of more than 108 dB cannot be maintained and a dual polarization function can not be realized.

Since isolation of more than 100 dB can be acquired in the embodiment, it can be usefully applied as an antenna for the unidirectional co-channel repeater system.

While the present invention has been described with respect to certain preferred embodiments, it will be apparent to those skilled in the art that various changes and modifications may be made without departing from the scope of the invention as defined in the following claims.

INDUSTRIAL APPLICABILITY

The present invention is used for a repeater system.

What is claimed is:

1. A transmitting/receiving isolation antenna for a repeater for maintaining isolation between transmission and reception signals in a unidirection, comprising:

a shielding unit including an electric conductor;

a first antenna of a dipole antenna type in one side of the shielding unit; and a second antenna of a loop antenna type in an opposite side of the shielding-unit; and an antenna device supporting unit setting up in center of the first antenna and second antenna to support the first antenna and the second antenna;

wherein the first antenna generates a radiated wave;

wherein the radiated wave forms a scattered wave in the antenna device supporting unit;

wherein the antenna device supporting unit symmetrically sets up in the center to transmit symmetrically the scattered wave to the second antenna.

2. The isolation antenna as recited in claim 1, further comprising:

an antenna supporting unit of a pipe shape which has a space inside and is connected to the shielding unit to support the shielding unit.

3. The isolation antenna as recited in claim 2, further comprising:

a base for holding up the antenna supporting unit perpendicularly to a surface on which the isolation antenna is mounted by being connected to the supporting unit.

4. The isolation antenna as recited in claim 3, wherein the base includes an electric wave absorbent for absorbing electric wave.

5. The isolation antenna as recited in claim 4, wherein the shielding unit is formed as a housing type having a space inside.

6. The isolation antenna as recited in claim 4, wherein the second antenna is a loop antenna of a rectangle shape.

7. The isolation antenna as recited in claim 6, wherein the second antenna is fed in a central part of one side.

8. A transmitting/receiving isolation antenna for a repeater for maintaining isolation between transmission and reception signals in a unidirection, comprising a shielding unit including an electric conductor;

a first antenna of a dipole antenna type in one side of the shielding unit;

a second antenna of a loop antenna type in an opposite side of the shielding unit;

wherein the first antenna includes:

a left antenna device with a predetermined length and a straight line shape;

a right antenna device which has the same size and shape as the left antenna and is symmetrically positioned adjacently to the left antenna;

a feeding unit for feeding by being positioned between the left and right antenna devices;

a left antenna device supporting unit for fixing the left antenna device at a predetermined distance from the shielding; and a right antenna device supporting unit which has the same size and shape as the left antenna device supporting unit and is symmetrically positioned to the left antenna device supporting unit in order to fix the right antenna device on the shielding unit at the same distance as the distance between the left antenna device and the shielding unit.

9. The isolation antenna as recited in claim 8, wherein the feeding unit uses a connector.

10. The isolation antenna as recited in claim 8, wherein the left and right antenna device supporting unit have a pipe shape having a space inside and are connected to the shielding unit in the way that the inside of each antenna device supporting unit is directly connected to that of the shielding unit.

11. The isolation antenna as recited in claim 8, wherein the first antenna is a transmitting antenna.

12. A transmitting/receiving isolation antenna for a repeater for maintaining isolation between transmission and reception signals in a unidirection, comprising;

a shielding unit including an electric conductor;

a first antenna of a dipole antenna type in one side of the shielding unit;

a second antenna of a loop antenna type in an opposite side of the shielding unit;

wherein the second antenna includes:

an upper antenna device which is positioned in an upper part of the shielding unit;

a lower antenna device which has the same size and shape as the upper antenna device in a lower part of the shielding unit and is symmetrically positioned to the upper antenna device;

a left feeding unit for feeding by being positioned in the left end of the upper antenna device;

a right feeding unit for feeding by being positioned in the right end of the lower antenna device;

an upper antenna device supporting unit for fixing the upper antenna device at a predetermined distance from the shielding unit and horizontally in one side of the shielding unit; and a lower antenna device supporting unit for fixing the lower antenna device at a predetermined distance from the shielding unit and horizontally in one side of the shielding unit.

13. The isolation antenna as recited in claim 12, wherein the shielding unit includes:

a power combining unit for integrating a signal by being connected to the left and right feeding unit by cables of the same length in the inside of the shielding unit.

14. The isolation antenna as recited in claim 13, wherein the power combining unit outputs power subtraction or power summation of input voltage by using a 4-terminal hybrid combiner.

15. The isolation antenna as recited in claim 14, wherein the 4-terminal hybrid combiner connects two input terminals to the left and right feeding unit, connects one output terminal to the feeding unit of the first antenna, and connects a terminator to the other output terminal.

16. The isolation antenna as recited in claim 15, wherein the left and right feeding unit feed in opposite directions, and the power combining unit connects an 180° output terminal to the feeding unit of the first antenna to realize the power subtraction.

17. The isolation antenna as recited in claim 15, wherein the left and right feeding unit feed in opposite direction to each other, and the power combining unit connects an 0° output terminal to the feeding unit of the first antenna to realize the power summation.

18. The isolation antenna as recited in claim 12, wherein the left and right feeding unit use a connector.

19. The isolation antenna as recited in claim 12, wherein the upper antenna device supporting unit and the lower antenna device supporting unit have a structure of a pipe shape having a space inside in order that a feeding path can be connected to the inside of the shielding unit through the inside of them.

20. A transmitting/receiving isolation antenna for a repeater for maintaining isolation between transmission and reception signals in a unidirection, comprising:

a shielding unit including an electric conductor;

a first antenna of a dipole antenna type in one side of the shielding unit the first antenna comprising:

a left antenna device positioned in the left part of the shielding unit and a right antenna device positioned in the right part of the shielding unit, the left and right antenna devices having the same size and shape and being positioned symmetrically; and a left antenna device supporting unit and a right antenna device supporting unit fixing the left antenna device and the right antenna device, respectively, to the shielding unit, the left and right antenna device supporting units having the same size and shape and being positioned symmetrically such that the distance between the left antenna device and the shielding unit is the same as the distance between the right antenna device and the shielding unit;

a second antenna of a loop antenna type in an opposite side of the shielding unit, the second antenna comprising:

a lower antenna device positioned in the lower part of the shielding unit and an upper antenna device positioned in the upper part of the shielding unit, the upper and lower antenna devices having the same size and shape and being positioned symmetrically an upper antenna device supporting unit and a lower antenna device supporting unit for fixing the upper antenna device and the lower antenna device, respectively, to the shielding unit, the upper and lower antenna device supporting units having the same size and shape and being positioned symmetrically such that the distance between the upper antenna device and the shielding unit is the same as the distance between the lower antenna device and the shielding unit.

* * * * *